United States Patent [19]

Glück et al.

[11] 4,239,406

[45] Dec. 16, 1980

[54] HINGED SINGLE PIECE ALIGNING SCALE FOR TYPEWRITERS

[75] Inventors: Otto Glück, Schoneck; Norbert Jakovski, Frankfurt, both of Fed. Rep. of Germany

[73] Assignee: Triumph Werke Nurnberg A.G., Nurnberg, Fed. Rep. of Germany

[21] Appl. No.: 51,531

[22] Filed: Jun. 25, 1979

[30] Foreign Application Priority Data

Jul. 7, 1978 [DE] Fed. Rep. of Germany ..... 2829935

[51] Int. Cl.[3] ..... B41F 13/10

[52] U.S. Cl. ..... 400/645; 400/647.1; 400/703; 400/536

[58] Field of Search ..... 400/645, 645.4, 645.5, 400/647, 647.1, 703, 705, 705.4, 705.5, 706, 706.1, 709, 709.1, 709.2, 642, 247, 248, 536–540

[56] References Cited

U.S. PATENT DOCUMENTS

| | | | |
|---|---|---|---|
| 1,071,495 | 8/1913 | Yaw | 400/540 |
| 2,616,365 | 11/1952 | Hicks et al. | 400/621 |
| 3,901,372 | 8/1975 | Denley | 400/703 |

FOREIGN PATENT DOCUMENTS

| | | | |
|---|---|---|---|
| 2451254 | 5/1976 | Fed. Rep. of Germany | 400/709 |
| 761117 | 11/1956 | United Kingdom | 400/709.1 |

OTHER PUBLICATIONS

Cassell, Cardholder & Paper Bail, IBM Technical Disclosure Bulletin, vol. 13, No. 11, p. 3539, Apr. 1971.

*Primary Examiner*—William Pieprz
*Attorney, Agent, or Firm*—Joseph R. Spalla

[57] ABSTRACT

A single piece paper guide device incorporating an aligning scale which is movably hinged to allow movement from a working position to a service position.

5 Claims, 4 Drawing Figures

Fig_1
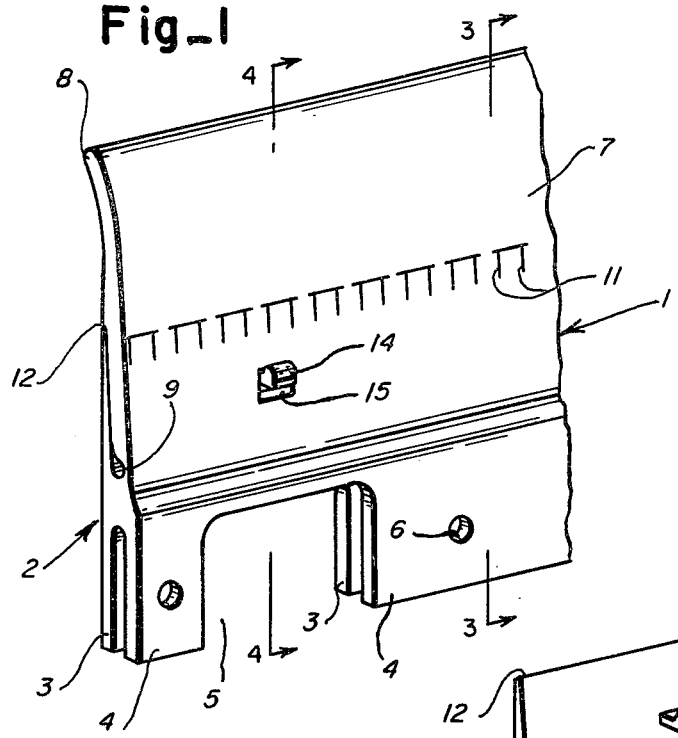
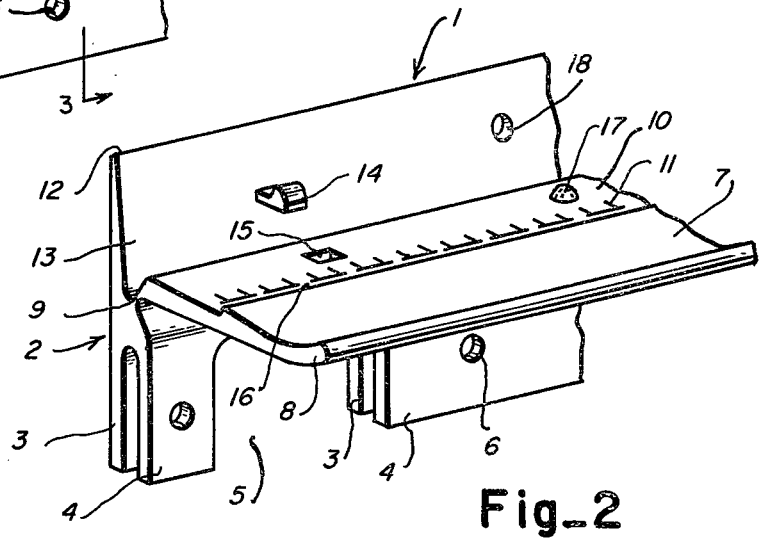
Fig_2
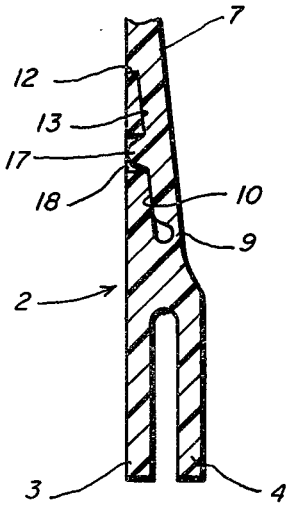
Fig_3
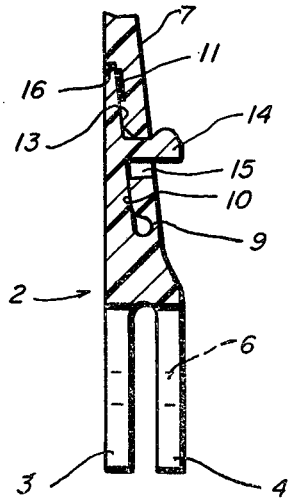
Fig_4

HINGED SINGLE PIECE ALIGNING SCALE FOR TYPEWRITERS

This invention relates to a paper guide device for typewriters or like machines; more particularly, it relates to a single piece paper guide device having a hinged aligning scale; and specifically, to a single piece paper guide device incorporating a hinged aligning scale molded from plastic.

Paper guides with aligning scales are known, for example, from German Utility Model Pat. No. 1,822,941. The device described therein consists of several parts, some of which are stamped parts which must be assembled, usually in a complicated assembly operation. Such devices are not only expensive but oftentimes present edges which interfere with the upper edge of the paper being inserted. Moreover, it is usual, over a period of time, that the color, e.g., paint or ink, employed to render the scale visible wears out or dissolves, rendering the scale markings difficult to read.

It is an object of the invention to provide a single piece paper guide aligning scale device which is inexpensive to manufacture and which functions reliably; one of which avoids edges which might interfere with paper insertion; and one wherein scale markings are guarded from wear.

Other objects and many of the attendant advantages of this invention will be readily appreciated as the same becomes better understood by reference to the following detailed description when considered in connection with the accompanying drawing in which like reference numerals designate like parts throughout the Figures thereof and wherein:

FIG. 1 is a partial perspective view showing a length of a paper guide device having an aligning scale in accordance with the invention in working position;

FIG. 2 is a partial perspective view similar to FIG. 1 with the scale portion in service position;

FIG. 3 is a cross-sectional view taken along lines 3—3 of FIG. 1; and

FIG. 4 is a further cross-sectional view taken along lines 4—4 of FIG. 1.

With reference to FIG. 2, there is shown a one-piece device, generally designated by reference numeral 1, molded of transparent plastic as it appears when removed from a plastic mold. The paper guide device 1 consists essentially of a body portion 2 by means of which it can be fastened onto a typewriter.

The body portion 2 includes parallel spaced depending rear and forward legs 3 and 4 extending across the length thereof with a cutout 5 therein as may be necessary for reasons not relevant here. The legs may also be provided with mounting holes 6 whereby the device may either be simply detachably plugged on with legs 3 and 4 resiliently embracing a typewriter part and/or screwed onto the typewriter part. Such guides in moving platen typebar machines are secured to the typewriter frame on either side of the fixed printing point, or to the carriage to either side of a moving printing point single element machine.

The device 1 also comprises an arcuate paper guide portion 7 whose rounded upper edge 8, in the working position shown in FIG. 1, extends beyond the upper edge of the body portion 2 and is adapted to engage the typewriter platen. The guide portion 7 is firmly connected at its lower end to the body portion bridging the upper part of legs 3 and 4 by means of a narrow web defining a hinge 9. The rearwardly facing side 10 of the guide portion 7 intermediate the upper and lower ends bears pi-shaped scale markings 11 to assist in aligning paper sheets. The upper bar of the scale markings 11 indicate the bottom of a writing line and the vertical lines the spacing distance from character to character as is conventional. When the guide portion 7 is latched in working position, as shown in FIGS. 1, 3 and 4, the scale markings 11 are at a level relative to the upper edge 12 of the body portion 2 such that they face the forward facing surface 13 of the body portion 2 and are thus guarded against abrasion from a platen or paper about the platen.

In order to securely hold the guide portion 7 in the operative working position shown in FIGS. 1, 3 and 4, a hook 14 extending from the forwardly facing surface 13 of the body portion 2 may be provided for entry into and for engagement with a cutout 15 in the guide portion 7. Alternatively, or in addition, as the plastic from which the device is made is flexible or resilient, it is possible, by appropriate design of an undercut on the rearwardly facing side 10 of the guide portion 7, to form an edge 16 for cooperation with the complimentary upper edge 12 of the body portion 2 to permit an interengagement of the two edges 12 and 16, thereby to retain the body and guide portions releasably latched in operation position. If found necessary, a lug 17 may be formed on the rear side 10 of the guide portion 7 for entry into an opening 18 for exact centering of the hinged guide portion 7. Assurance is thereby given that the scale is always exactly aligned.

As it is necessary, for example, for cleaning purposes and/or instances when the platen must be removed from the machine that the guide portion 7 be moved from the FIG. 1 to the FIG. 2 position, the device is made of a plastic which is sufficiently flexible as will allow rotation of the guide portion 7 about the hinge 9 for the life of the machine.

The invention claimed is:

1. A single piece paper guide device comprising
   - a body portion having an upper edge and a lower edge,
   - means on said body portion for securing said device to a typewriter,
   - a paper guide portion,
   - an integral web hingedly securing said paper guide portion to said body portion located between the upper and lower edges of said body portion whereby said guide portion may be pivoted from a working position parallel to and adjacent said body portion to a service position at an angle to said body portion, and
   - aligning scale indicia located on the side of said paper guide portion facing said body portion,
   - said indicia being so positioned as to be below the upper edge of said body portion when said paper guide portion is in working position.

2. A single piece paper guide as recited in claim 1, said device being a molded transparent plastic, and said paper guide portion when in working position extending beyond the upper edge of said body portion.

3. A single piece paper guide device as recited in claim 2, including releasable latching means for holding said paper guide portion in said working position.

4. A single piece paper guide as recited in claim 3, said latching means comprising a hook extending from said body portion and an opening in said paper guide portion to receive said hook.

5. A single piece paper guide as recited in claim 3, said latching means comprising complimentary edges on said body and paper guide portions.

* * * * *